United States Patent [19]

Christianson

[11] Patent Number: 5,067,709

[45] Date of Patent: Nov. 26, 1991

[54] UNASSISTED LOWER TORSO STRENGTHENING AND STRETCHING DEVICE

[75] Inventor: John Christianson, Milwaukee, Wis.

[73] Assignee: Tarrenn Corporation, Brookfield, Wis.

[21] Appl. No.: 443,117

[22] Filed: Nov. 29, 1989

[51] Int. Cl.[5] ..... A63B 21/12

[52] U.S. Cl. ..... 272/121; 272/903; 254/398

[58] Field of Search ..... 272/120, 121, 118, 93, 272/903; 254/390, 398, 399; 128/75

[56] References Cited

U.S. PATENT DOCUMENTS

| | | | |
|---|---|---|---|
| 427,314 | 6/1890 | Hanson et al. | 254/399 |
| 2,183,265 | 12/1939 | Maloney | 272/121 |
| 3,117,782 | 1/1964 | Johnson | 272/121 |
| 3,714,833 | 2/1973 | Gilson | 254/390 |
| 4,489,936 | 12/1984 | Dal Monte | 272/120 |
| 4,509,745 | 4/1985 | Angsten | 272/118 |
| 4,574,789 | 3/1986 | Forster | 272/120 |

FOREIGN PATENT DOCUMENTS

| | | | |
|---|---|---|---|
| 0732485 | 9/1932 | France | 254/398 |
| 407833 | 9/1966 | Switzerland | 272/121 |

*Primary Examiner*—Stephen R. Crow
*Attorney, Agent, or Firm*—Juettner Pyle & Lloyd

[57] ABSTRACT

A device for stretching and strengthening the muscles of the lower back and legs of a person in a supine position. The device includes a board with straps to restrain the pelvis of the person. A rope and pulley system, operated by the person by pulling and releasing extends between the feet and to a support above the head. The rope is pulled by the user to raise the legs, and additional mechanical advantage is employed as the rope is gradually released to lower the legs.

4 Claims, 3 Drawing Sheets

UNASSISTED LOWER TORSO STRENGTHENING AND STRETCHING DEVICE

BACKGROUND OF THE INVENTION

This invention related to a method and apparatus for stretching, exercising and strengthening the muscles of the lower back and legs, and more particularly, to a method and portable apparatus which may be used and employed unattended by a single user.

A method for stretching hamstring and lower back muscles and strengthening such muscles is described in *The Goodbye Back Pain Handbook* by James A. Peterson et al (Masters Press, 5025 28th St., S.E., Grand Rapids, MI 49506). The authors describe lessened back pain and improved flexibility in hundreds of patients during a two year period. In general, the patient lies on a padded board and is restrained around the waist with a strap to stabilize the pelvis. A second person then places one foot on the board and lifts the patient's legs by the ankles upwardly toward the head in a repetitive manner to stretch the lower back and hamstring muscles. The same muscles are strengthened by having the assistant provide controlled resistance to downward movement of the legs.

While the above exercises and method have been proven effective, the method requires the use of an assistant or so-called training partner, preferably who has experience or training with the system. The requirement of an assistant limits the practical usage and availability of the method. The assistant must be available to lift the legs to about a 90 degree position, and then push the legs toward the head to stretch the muscles. Also, the assistant must hold the ankles and support the legs during downward movement. Different forces are required to execute these two separate phases, and the forces may vary, depending on the condition of the patient.

SUMMARY OF THE INVENTION

The apparatus present invention comprises two components, namely, a pelvis stabilizing means comprising a support board with a pelvis restraining strap, with the board being designed to prevent lifting of the board from the floor or support surface while being used. The second component is a rope and pulley system connected between the feet or ankles of the user and a support above the head of the user. The pulley and rope system terminates in a free end of the rope above the arms of the user, which allows the user to pull the legs upwardly toward the head, and to gradually lower the legs toward the floor.

The pulley and rope system is designed to provide a first mechanical advantage as the rope is pulled to lift the legs, and a second, greater, mechanical advantage when the legs are being lowered by gradual release of the rope. The system may comprise a pair of free pulleys to provide a two to one advantage in the upward or pulling direction. One of the pulleys may be in the form of a rope clutch or reverse friction device to resist movement in the other direction, i.e., when the legs are being pushed toward the floor. This allows a greater than two to one mechanical advantage in the other direction and lessens or eliminates the problem of undue stress or slippage of the rope through the hands of the user.

THE DRAWINGS

DESCRIPTION OF THE PREFERRED EMBODIMENTS

Figure 1:
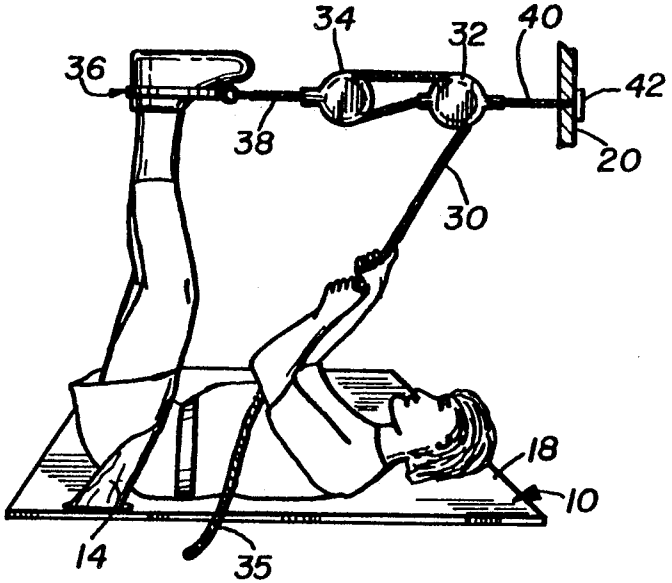
FIG. 1 is a side view of the overall apparatus of the present invention.
Figure 2:
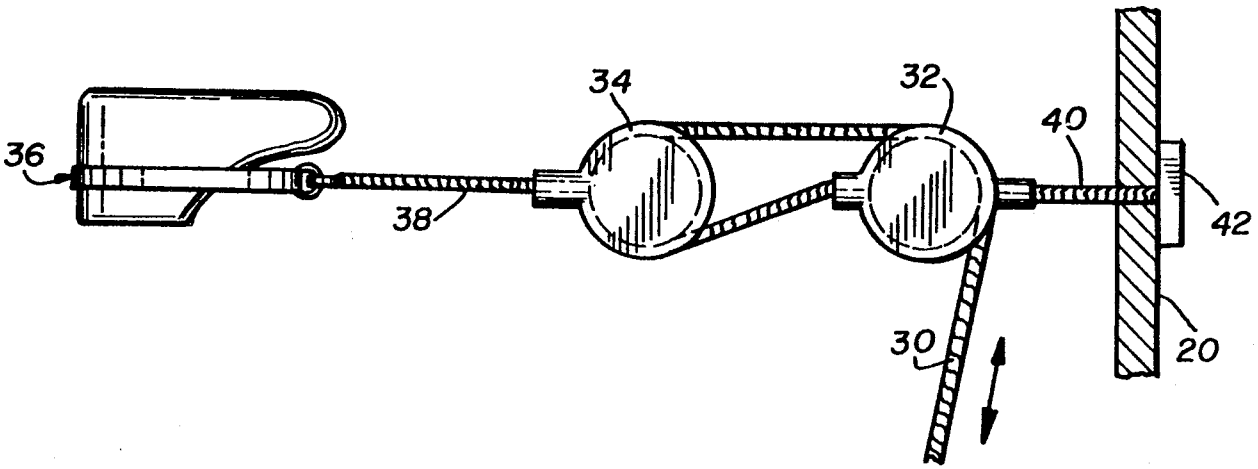
FIG. 2 is a view of the rope and pulley component of the present invention.
Figure 3:
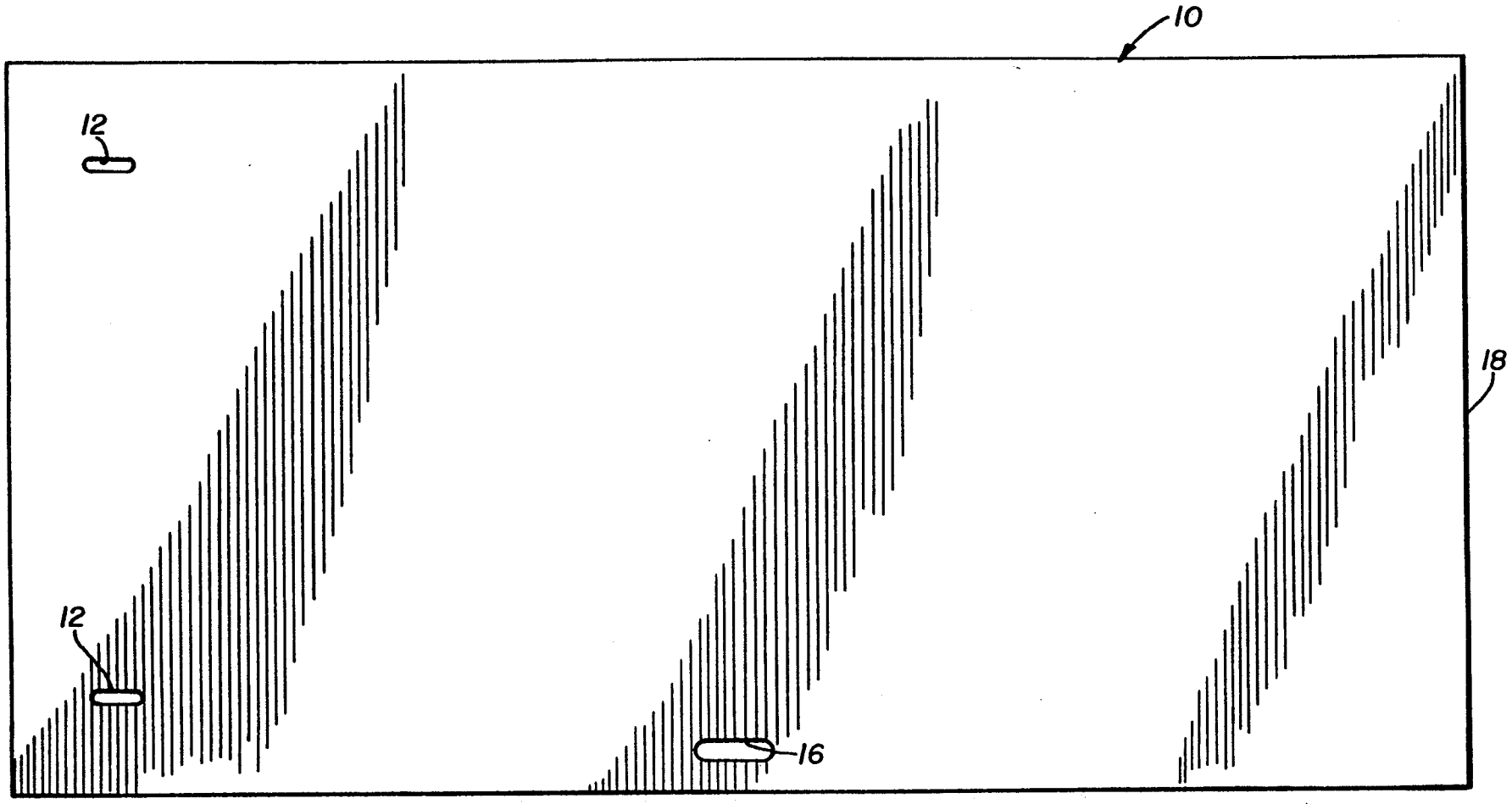
FIG. 3 is a plan view of the support board and pelvis restraint component of the present invention.

The two essential components of the present invention are shown in FIGS. 1–3. The first component comprises a means to restrain and immobilize the pelvis of the user in a fixed position relative to the other portions of the apparatus. The second component comprises a rope and pulley system extending between the ankles and to a position above the head of the user, said system being operable by the hands and arms of the user by pulling on and releasing the rope. The rope and pulley system includes means to provide greater mechanical leverage in the release direction than in the pulling direction.

The first component may comprise a flat rigid board 10 having planar dimensions to accommodate torso sizes of various users. The board may include means such as the indicated slots 12 near one end of the board adjacent the longitudinal edges thereof for securement of adjustable straps 14 which encircle the waist of the user and hold the pelvis against the board, while allowing the legs to swing upwardly. The board may include an additional slot 16 at the center near one edge to provide a hand hold to facilitate movement of the board from one location to another.

The purpose of the board 10 is to stably position and restrain the pelvis of the user relative to the location of the pulley system to be described herein. The board 10 is supported upon a horizontal surface and has a length which is greater than the upper torso and head of the user as shown. From experimentation, it has been found that a length between the slots 12 to the other or remote edge 18 of the board should be in the order of 40 to 44 inches. The edge 18 of the board abuts a vertical surface, such, as a wall 20, to prevent the board from moving lengthwise. Preferably, there is a length of board between the head of the user and the supported edge of the board 18, such that the body weight of the user will be enough greater than the lifting force of the pelvis strap 14 that the board will not significantly lift or fulcrum around the edge when in use.

The use of a separate board 10 having the pelvis support near one end and an abutting edge 18 at the other end enables the apparatus to be portable and easily moved from one location to another. Obviously, the pelvic support could be in a permanent location, or the board could be otherwise secured to its supporting surfaces.

The second component comprises a mechanical system to enable the user to lift or rotate one or more legs from the ankles or feet in the supine position upwardly and generally toward and away from the head in a controlled fashion. In the preferred embodiment, the mechanical system is a pulley and rope system connected between the ankle area of the user and a support above the head of the user. The rope may be pulled and released by the user in a lightly controlled fashion to raise and lower the legs as hereinafter described.

As shown in FIGS. 1 and 2, the system preferably comprises a rope 30 having one end connected to a first pulley 32, extending around a second pulley 34 and then around the first pulley to a free end operable by the hands of the user. Means, such as boots 36, straps, or other supports, extend around the feet or ankles of the user, and a line 38 is connected between the boots 36 and to the sides or non-rotating portion of the second pulley 34.

The first pulley 32 is provided with a head which is connected by a line 40 to a support generally above and to the rear of the head of the supine user, as shown. The support may comprise a terminus such as a disc 42 located on the other side of a closed door in the well known fashion, as shown. The door is opened, and the disc 42 is placed on th other side before the door is closed, with the flexible line 40 extending between a crack between the door edge and the frame.

As shown in FIG. 1, the line 40 is preferably supported at a height such that the pulley system is substantially horizontal when the legs are raised to a 90 degree angle as shown. This may be accomplished by supporting the line 40 at approximately the height of the navel of the user from the ground.

The pulleys 32 and 34 provide what is a two part system in which the pulley 34 moves toward and away from the relatively fixed pulley 32 as the rope 30 is pulled in and released by the user. Both pulleys are designed to turn freely as the free end of the rope 30 is pulled by the user, providing a two to one mechanical advantage to facilitate the lifting and stretching movement.

The relatively movable pulley 34 is designed to provide resistance to the passage of the rope when the rope is released gradually by the user. Such pulley may include a ratchet mechanism and a special pulley sheave to provide additional resistance and mechanical advantage in the release direction.

Various types of one way rope clutches may be employed to achieve the described function of pulley-clutch 32. One particularly suitable type is sold under the trademark "HEXARATCHET" by Harken, Inc. of Pewaukee, Wisc., U.S.A. The bearing block is described in more detail in Gilson U.S. Pat. No. 3,714,838, incorporated herein by reference to FIGS. 4 and 5.

Figure 5:
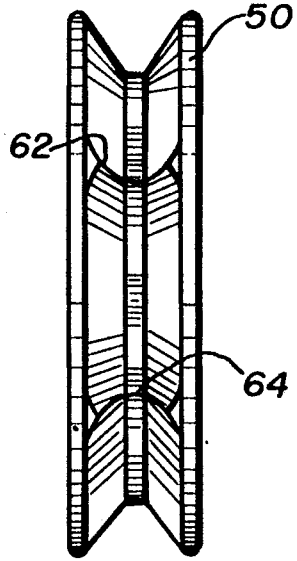
FIG. 5 is an end view of the sheave of the ratchet block shown in FIG. 4.
Figure 4:
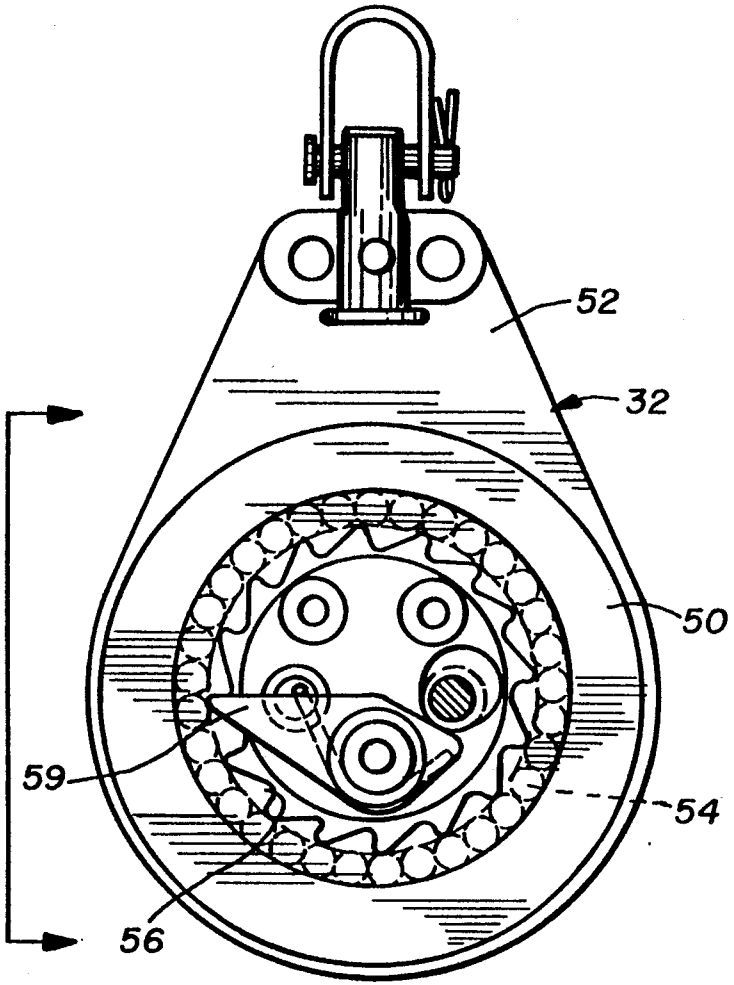
FIG. 4 is a vertical sectional view of a ratchet pulley which may be employed in connection with the present invention.

As shown in FIGS. 4 and 5, the pulley-clutch 32 comprises a grooved, rope-receiving sheave 50 which is disposed between side plates 52 and rotates around an axis on bearings 54. The sheave 50 may have inwardly projecting teeth 56 which are engageable by a spring loaded pawl 59 in one direction of rotation. In the other direction of rotation, the pawl 59 slides over the teeth 56. Thus, the sheave 50 can rotate in only one direction.

As shown in FIG. 5, the rope receiving groove 60 of the sheave 50 may have an irregular surface such as v-shaped shoulders 62 on the sides of the grooves and chordal segments 64 at the bottom of the groove. This increases sliding friction between the rope and stationary sheave to obtain a frictional mechanical advantage in the order of about from five to fifteen to one, depending on the tension of the rope. Generally, the mechanical advantage or friction increases in proportion to the tension on the rope, as more fully described in the aforesaid U.S. patent.

The use of the apparatus of the present invention will now become apparent. Once the apparatus has been assembled as shown in FIG. 1, the user pulls on the rope 30 with the legs unbent until the legs are in an upright position, or approximately 90 degrees to the board 10. The pulley arrangement shown is a 2 to 1 system, by which two unit lengths of rope are pulled downwardly to provide one unit length of upper lift. This facilitates lifting the legs to an upright position with the use of the hands and arms alone.

With the legs in the upright position, two different types of exercise are possible. Additional pulling on the rope to a controlled and limited degree causes the feet and ankles to move toward the head to stretch the muscles in the lower extremities.

A second type of exercise is one in which the user provides muscle power to push the feet from an upright position toward the floor in a gradual manner while allowing slippage of the free end of the rope. Since the large muscles in the lower body together with gravity can produce a large downward force, a corresponding resistance is generated by the pulley system, especially at the ratchet block. Otherwise, the large forces might cause the rope to slip through the hands of the user, with resulting rope burns or muscle strain or injury.

I claim:

1. An unassisted lower torso strengthening and stretching device for a person comprising means for restraining the pelvis of the person while allowing upward tilting of the legs, and means operable by the user for raising and lowering the legs to a position where the legs are substantially perpendicular to the torso, said last mentioned means comprising a first pulley, means for supporting said first pulley above the person, a second pulley connected to the feet of the person, and a line having a free end operable by the user to raise and lower the legs, said line passing over the first pulley, around said second pulley, and the other end of said line being secured to said first pulley, said first pulley comprising means for allowing rotation thereof while pulling on said line, and means for preventing rotation thereof upon release of said line.

2. The device of claim 1 wherein the means for supporting said first pulley above the person comprises a support, and means for connecting said first pulley to said support.

3. The device of claim 2 wherein the support is a doorway, and the means for connecting said first pulley to the support comprises a line having one end attached to said pulley extending through one side of said doorway, and an enlarged member on the other side of said doorway secured to the other end of said line. of said line.

4. The device of claim 1 wherein the means for restraining the pelvis comprises support means under the back of the person, and means for securing the pelvis of the person to said support means.

* * * * *